United States Patent [19]

Hagemeister et al.

[11] Patent Number: 4,800,955

[45] Date of Patent: Jan. 31, 1989

[54] HEAT EXCHANGER

[75] Inventors: Klaus Hagemeister, Munich; Alfred Hueber, Merching, both of Fed. Rep. of Germany

[73] Assignee: MTU Motoren- und Turbinen-Union Munchen GmbH, Munich, Fed. Rep. of Germany

[21] Appl. No.: 106,237

[22] Filed: Oct. 8, 1987

[30] Foreign Application Priority Data

Oct. 20, 1986 [DE] Fed. Rep. of Germany ..... 3635548

[51] Int. Cl.[4] ..... F28D 7/06

[52] U.S. Cl. ..... 165/163; 165/176; 165/910

[58] Field of Search ..... 165/163, 176, 910, 162

[56] References Cited

U.S. PATENT DOCUMENTS

| | | | |
|---|---|---|---|
| 1,817,978 | 8/1931 | Feldmeier | 165/176 |
| 1,890,429 | 12/1932 | Griswold, Jr. | 165/176 X |
| 3,746,525 | 7/1973 | Kasuga et al. | 165/176 X |
| 3,808,815 | 5/1974 | Friedemann | 165/176 X |
| 4,679,619 | 7/1987 | Wöhrl et al. | 165/159 |

FOREIGN PATENT DOCUMENTS

| | | | |
|---|---|---|---|
| 609526 | 5/1956 | Fed. Rep. of Germany | 165/163 |
| 1168243 | 12/1958 | France | 165/163 |
| 372273 | 3/1939 | Italy | 165/163 |
| 464316 | 4/1937 | United Kingdom | 165/176 |

*Primary Examiner*—Ira S. Lazarus
*Assistant Examiner*—Peggy Neils
*Attorney, Agent, or Firm*—Roberts, Spiecens & Cohen

[57] ABSTRACT

A heat exchanger having an inlet duct for admission of a first fluid to be heated, an outlet duct for discharge of the first fluid after heating thereof, the ducts being arranged in substantially parallel relation, and an assembly of a plurality of heat exchanger tubes connected to the inlet and outlet ducts for receiving the first fluid from the inlet duct to convey the first fluid through the tubes for discharge into the outlet duct. The heat exchanger tubes are of U-shape, each including first and second straight leg portions respectively connected to the inlet and outlet ducts and a curved bend region connecting the straight leg portions for reversing the direction of flow of the first fluid from the first leg portion to the second leg portion. The assembly of heat exchanger tubes projects laterally of the ducts into the path of travel of a second fluid which flows around the tubes in a passage area. The heat exchanger tubes are arranged in a matrix of rows and columns in which the straight leg portions of the tubes are spaced apart a greater distance than the spacing between the curved bend regions of the tubes.

12 Claims, 7 Drawing Sheets

IX
IX
$6_1$
$6_9$
$6_{10}$
$6_8$
M
G
$4_2$
$4_1$
$4_{10}$
$5_{10}$
$5_2$
$5_1$
1
2
B
M
A

HEAT EXCHANGER

FIELD OF THE INVENTION

The present invention relates to a heat exchanger having an inlet duct for admission of a first fluid to be heated, an outlet duct for discharge of said first fluid after heating thereof, said ducts being arranged in substantially parallel relation, and an assembly or matrix of a plurality of heat exchanger tubes connected to said inlet and outlet ducts for receiving said first fluid from the inlet duct for flow through said tubes for discharge into said outlet duct. The heat exchange tubes are of U-shape, each including first and second straight leg portions respectively connected to said inlet and outlet ducts and a curved bend region connecting said straight leg portions for reversing the direction of flow of said first fluid from said first leg portion to said second leg portion. The assembly of heat exchanger tubes projects laterally of said ducts into the path of travel of a second fluid which flows around said tubes in a passage area to effect heat exchange with said first fluid in said tubes.

DESCRIPTION OF PRIOR ART

A heat exchanger of the above type is known from GB-OS 2,130,355.

In such heat exchanger, heat exchange from the fluid flowing around the tubes, such as hot gases, and the fluid flowing in the tubes, such as compressed air, is effected by a crossflow/counterflow operation.

In such heat exchangers of the crossflow/counterflow type, two regions of the matrix can be distinguished with regard to the flow:

The region of the substantially straight leg portions of the tubes represents the actual regularly traversed region of the crossflow/counterflow heat exchanger and the arcuate region, which is necessary for structural reasons, and around the tubes of which the hot gases flow in locally different directions.

The relative position of the tubes in the flow field of the heat exchanger matrix is determined by the requirements of the transverse flow in the straight leg portions of the tubes. This relation is carried over into the curved bend regions of the tubes in the arcuate region of the matrix. Since the externally flowing fluid i.e. the hot gases, flow substantially in the same direction of flow as in the straight leg portion the hot gases travel locally over flow cross sections which differ considerably from those in the straight leg portions.

This is particularly evident by comparison of the effective flow cross sections around the regularly traversed straight leg portions with those at the peak of the bend regions in which the tubes are turned 90° with respect to the straight leg portions.

There is a disadvantage that the hot gases tend to flow through the arcuate region, whereby an undesired displacement of the mass-flow distribution takes place in favor of this arcuate region.

The reasons for this disadvantage are described in detail further as follows:

If the transverse flow of the externally flowing hot gases is broken down conceptually into flow tubes of the same cross section, then flow tubes of the arcuate region effectively define open cross sections which are larger than those in the regularly traversed region formed by the straight leg portions of the matrix.

In the outer area of the arcuate region of the matrix the path of the flow is smaller (corresponding approximately to the length of the chord of the corresponding arcute section) and therefore the resistance to flow is less.

In the arcuate region, the diameters of the hot-gas passages are larger and therefore the resistancto flow are comparatively less.

The character of the boundary layer flow of the hot gases along the tubes is different in the arcuate region as compared to the regularly traversed region with the straight leg portions, since the travel length of the boundary layer along the tubes is longer. In contradistinction to this, in the regularly traversed region, the boundary layers are continuously newly established upon change from one tube around which the gases flow to the next tube arranged behind it in the direction of the transverse flow.

Another substantial disadvantage of the known heat exchanger is that no precisely definable crossflow/-counterflow heat-exchange process can be obtained over relatively wide parts of the arcuate region of the matrix.

SUMMARY OF THE INVENTION

An object of the invention is to provide a heat ex changer with U-shaped tubes in a matrix array of columns and rows in which the curved bend regions of the tubes are so contructed to provide a comparatively high degree of heat exchange between the fluid conveyed in the tubes and the fluid flowing outside the tubes.

This object is achieved by spacing the straight leg portions of the tubes at a greater distance than the spacing between the tubes in the curved bend regions.

By virtue of this construction, the non-uniform hot-gas mass-flow distribution between the straight leg portions of the tubes, i.e. the linear sections of the matrix and the curvec bend regions of the tubes, i.e. the arcuate sections of the matrix, can be made uniform.

By bringing the spaced tubes more closely together within the curved bend region, the local flow of fluid therearound i.e. hot gases, in the arcuate region of the matrix can be adapted to the requirements of a locally balanced heat-exchange performance.

In further accordance with the invention, the greatest degree of compacting of tubes can be obtained in the arcuate region in a median plane lying essentially perpendicular to the main direction of flow of the hot gases. The degree of compacting of the tubes can gradually diminish in planes angularly deviating from said median plane forwardly and rearwardly thereof.

In further accordance with the invention, instead of a common center for the curved bend portions of the tubes as in the prior art, the centers of the bend portions for the individual radii of curvature are continuously spaced from the inside to the outside in the median plane.

Within the scope of the invention, the straight leg portions of the tubes of the matrix can be spaced apart at the required uniform distances within the stream of hot gas flow.

Within the scope of the invention, it is furthermore possible for the straight leg portions of the tubes of the matrix, in a plane perpendicular to the feed and discharge ducts, to be incrementally increased in length such that the connecting ends of the curved bend regions of the tubes lie in an oblique plane, for example, which is produced by the difference in The centers between the smallest (inner) and the largest (outer) radii of the curved bend regions.

The increase in length of the straight leg portions leads to a uniform distribution of the resistance to flow within the tubes since the length of the flow path of the bend regions which are closer to the inside of the matrix becomes larger and whereas the length of the bend regions further to the outside of the matrix remains practically unchanged.

Preferably, the bend regions of the tubes within the arcuate region of the matrix which lie further radially outwards, and therefore those bend regions of comparatively large radii, are overlapped to a greater degree than the radially inner bend regions of comparatively smaller radii.

The hot gases flowing transversely through the matrix then have smaller cross sections of area for flow, particularly near the zenith of the arcuate region, and therefore flow with greater intensity through the radially inner areas of the arcuate region, i.e. through the bend regions having the smaller radii. In this way, the flow through the arcuate region no longer takes place only along the chords of the circular arcs but a large component of tran verse flow is produced, preferably through the outer bend regions or larger radius The region at the zenith of the bends, which is particularly densely compacted, thus represents the core of a zone through which the hot gases only slightly flow.

This weakly traversed zone is formed along one side by the outermost arcuate contour of the tubes and extends into the arcuate zone along a curved path of opposite curvature so that said zone is approximately of mushroom shape. In said arcuate region of the matrix, therefore, the main mass of the hot gases flows around the mushroom-shaped zone and thus promotes an intensified transverse flo of hot gases around the tubes which favors the crossflow/counterflow heat-exchange process through the remainder of the arcuate region.

Another advantageous consequence of this last-mentioned arrangement is that a bounding surface of the housing or a guide wall facing the curved bend region can be limited to a relatively narrow portion at the zenith of the arcuate region of the matrix.

DETAILED DESCRIPTION OF THE EMBODIMENTS OF THE INVENTION

Figure 1:
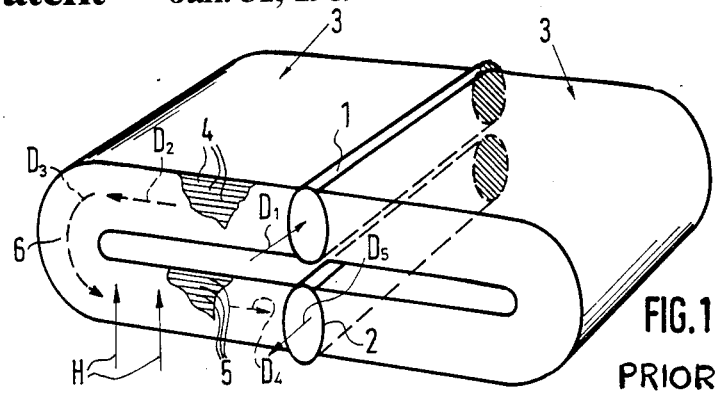
FIG. 1 PRIOR ART
FIG. 1 is a diagrammatic perspective view, partly broken away, of a heat exchanger, according to the prior art.

Referring to FIG. 1, therein is seen a conventional heat exchanger which comprises an assembly or matrix 3 of heat exchanger tubes of U-shape which are positioned within a housing or casing (not shown) such that heated gases H can flow over the tube matrix 3 in the direction of the arrows.

The U-shaped tubes of the matrix 3 have straight legs 4 connected to an inlet duct 1 and straight legs 5 connected to an outlet duct 2. The ducts 1 and 2 extend substantially parallel to one another in a direction perpendicular to the flow of hot gases H. The tubes of the matrix extend in equally spaced parallel relation in the matrix along the length of ducts 1 and 2 and the tubes project transversely of the ducts into the path of flow of gases H.

A fluid, such as compressed air, is supplied to the duct 1 as shown at $D_1$ and the fluid flows from duct 1 into the straight legs 4 of the heat exchanger tubes along path $D_2$. The compressed air undergoes reversal of direction along path $D_3$ in curved bend portions of the tubes in an arcuate reversal region 6 of the matrix whereafter the compressed air flows in straight legs 5 of the heat exchanger tubes along paths $D_4$ into duct 2 from which the compressed air is discharged at $D_5$. The ducts 1 and 2 are closed at their rear ends as shown by the hatching thereat.

In its path of travel through the tubes of the matrix, the compressed air is heated by the gases H flowing around the exterior of the tubesso that the compressed air discharged from duct 2 is heated. The heated compressed air can be supplied to a utilization means such as the combustion chamber of a gas turbine plant.

The tubes of the matrix 3 are arranged in staggered relation in rows and columns in parallel relation and the tubes are oval in cross-section to provide streamlined flow of the hot gases H therearound.

The two ducts 1, 2 can be integrated in a common duct or manifold with a partition therein.

Figure 2:
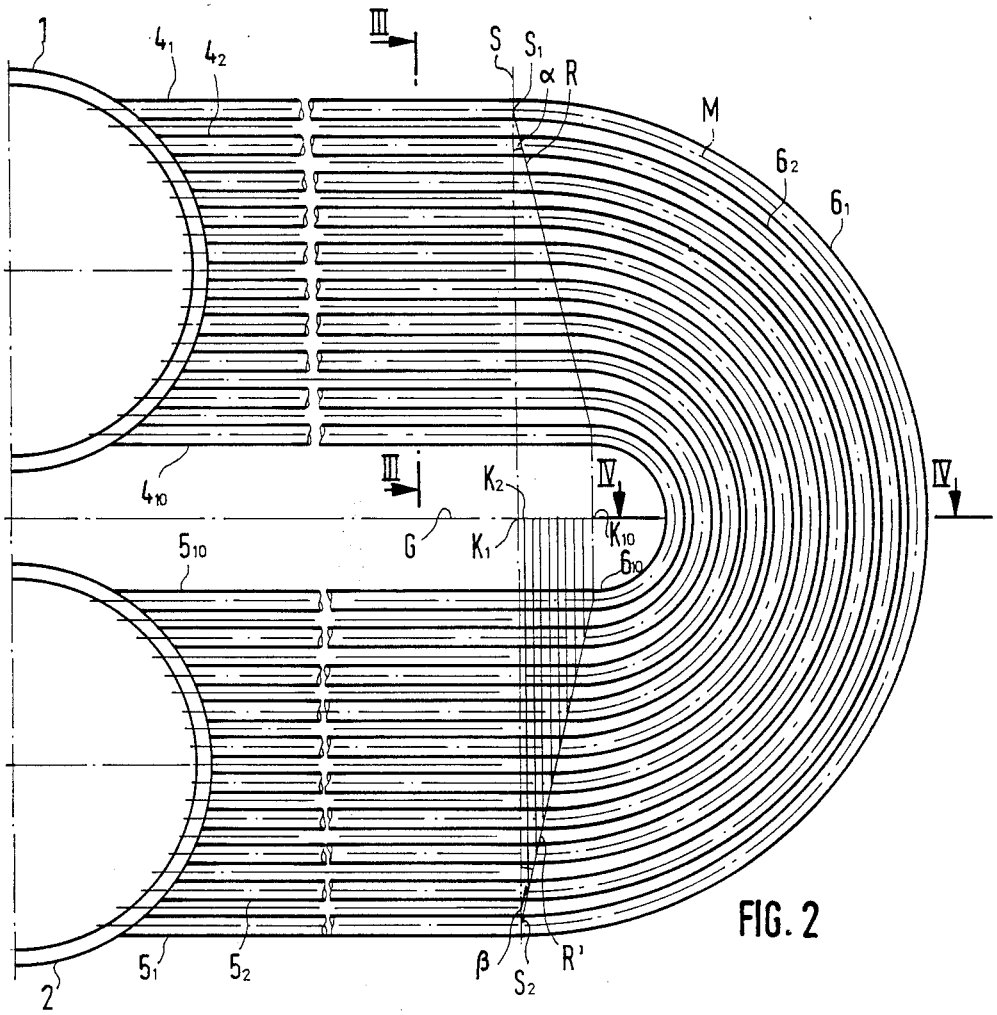
FIG. 2 is a front elevational view of one half of a heat exchanger, broken in length, according to a first embodiment of the invention.
Figure 3:
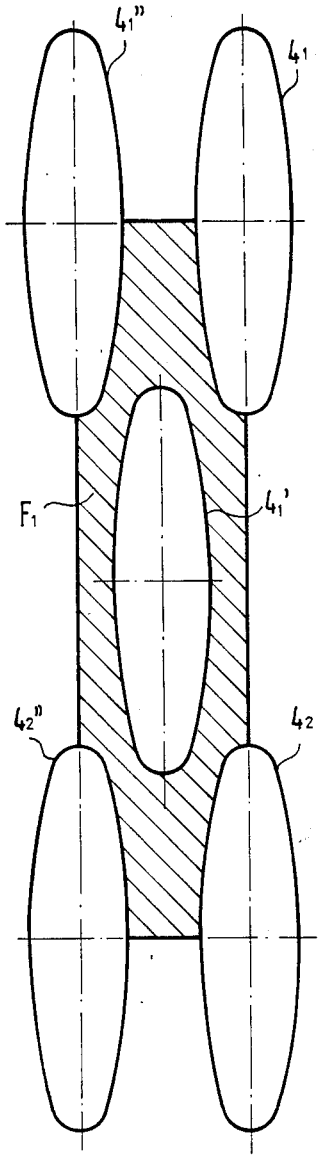
FIG. 3 is a partial section taken along line III—III in FIG. 2.
Figure 4:
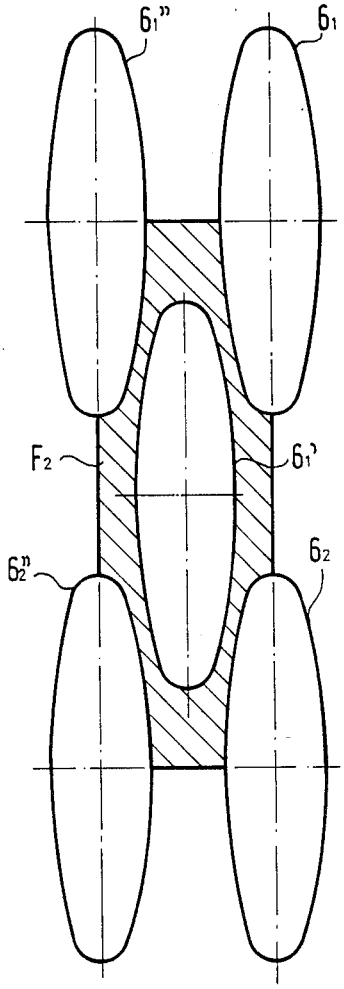
FIG. 4 is a partial section taken along line IV—IV in FIG. 2.

Referring to FIGS. 2, 3 and 4, the basic concept of the invention is expressed by the fact that the spacing between the tubes in the arcuate reversal region 6 of the matrix 3 is less than in the region of the matrix in which the tubes have straight legs 4 and 5.

Referring to FIGS. 2–4, the tubes areoffset in rows and columns in order to be internested one within the other, in each case in a common plane, for example, for the straight leg portions $4_1$, $4_2$ to $4_{10}$ and $5_1$, $5_2$ to $5_{10}$ and the curved bend portions $6_1$, $6_2$ to $6_{10}$ in the arcuate region of the matrix. In general, it can be stated that the arrangement of the tubes in rows and columns is in offset staggered relation to provide the interhesting in planes which extend transversely to the ducts 1, 2. In a common median plane in the reversal region 6 i.e. in the plane containing section IV—IV (FIG. 2), the tubes $6_1$, $6_2$ to $6_{10}$ are spaced at smaller distances than are the straight leg portions $4_1$, $4_2$ to $4_{10}$ and $5_1$, $5_2$ to $5_{10}$. In accordance with FIGS. 2 and 4 it can furthermore be noted that the bend portions $6_1$, $6_2$ to $6_{10}$ contained in the arcuate reversal region 6, the tubes are arranged at uniform, relatively small distances above and alongside one another.

Strictly speaking, in accordance with FIG. 2 the arcuate reversal region 6 consists of semi-circularly curved bend portions extending from the outside to the inside successively designated $6_1$, $6_2$ to $6_{10}$. The centers of the bend portions are designated $K_1$, $K_2$ to $K_{10}$ and are displaced progressively outwards,on a common straight line G, coresponding to the spacing of the tubes in the arcuate region 6 and the reduction in radius from the outside to the inside, in each transverse plane. In the embodiment shown in FIG. 2, therefore, the centers $K_1$, $K_2$, up to $K_{10}$ are arranged one after the other at equal spacing on the straight lines G.

From FIG. 2 it can therefore be noted that the curved bend portions $6_1$, $6_2$ to $6_{10}$ continuously merge with the corresponding straight leg portions $4_1$, $4_2$ to $4_{10}$ and $5_1$, $5_2$ to $5_{10}$. Furthermore, from FIG. 2 it can be seen that there is an increasing gain in length of the curved bend portions which increases, from the outside to the inside, corresponding to the straight leg portions ($4_1$, etc. and $5_1$, etc.), this gain in length resulting from the progressive displacement of the centers. Thus in FIG. 2, the straight leg portions terminate along obliquely extending lines R, R' which are at equal angles of inclination/ with respect to a perpendicular line S which intersects the center $K_1$ lying on the straight line G and furthermore passes through the common points of intersection $S_1$, $S_2$ of the lines R, R' at the center line M through the outermost tube $6_1$.

In accordance with FIGS. 3 and 4, the tubes $4_1$, $4_2$, $4_1'$, $4_1''$, $4_2''$ of the straight leg portion of the matrix and the corresponding bend portions $6_1$, $6_2$, $6_1'$, $6_1''$, $6_2''$ connected therewith are in each case three-dimensionally internested. Assuming a constant spacing of the tubes along the length of the ducts 1, 2, FIG. 4 shows a passage area $F_2$ for flow of hot gases which is reduced compared to passage area F: in FIG. 3. In other words, FIG. 3 shows the conventional spacing and staggering of the tubes and FIG. 4 shows the desired, closer spacing and staggering of the tubes.

Figure 5:
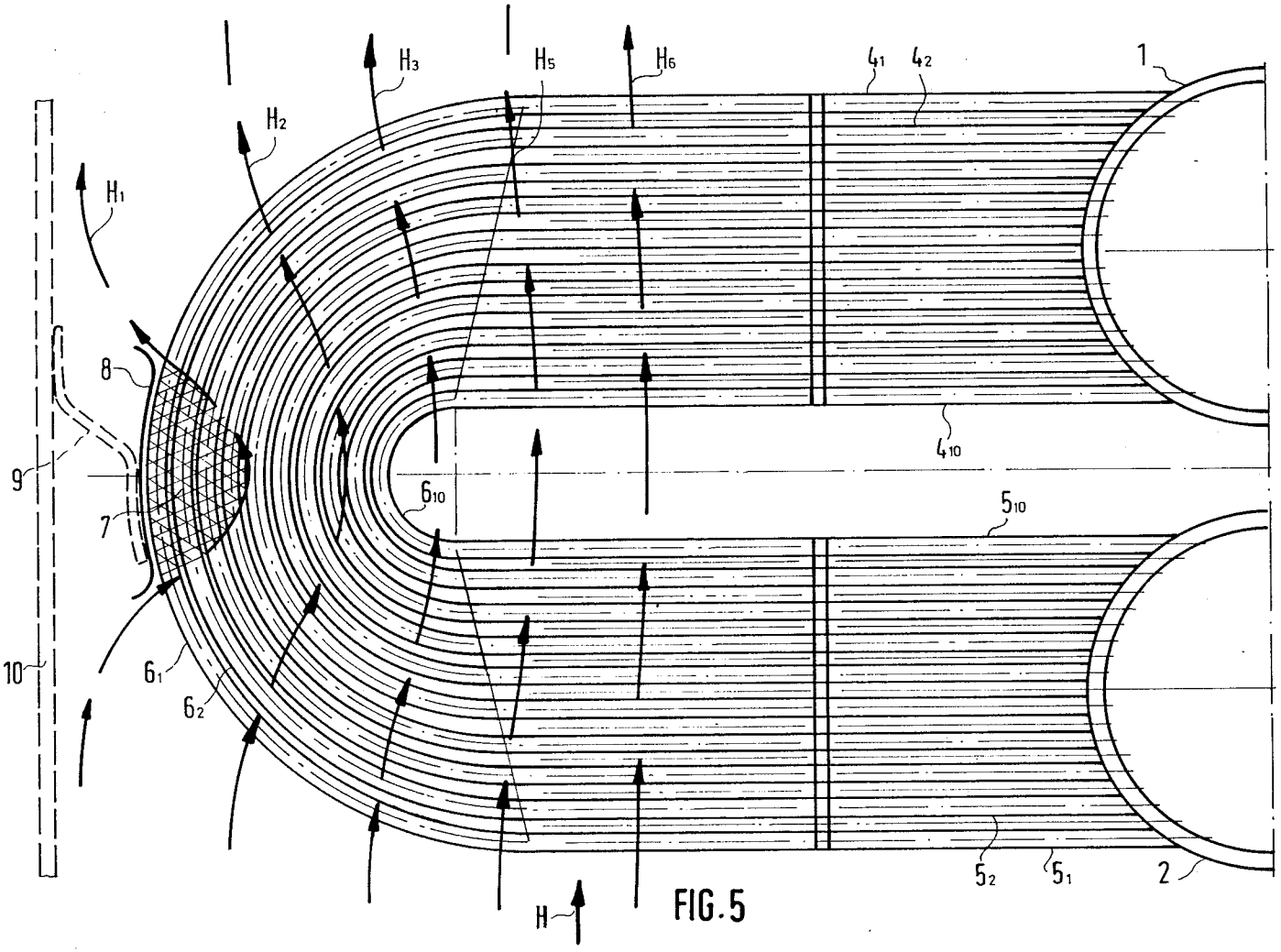
FIG. 5 is a front view of the left-half of the heat exchanger in FIG. 2 showing the hot gas flow around the tubes of the matrix.

With the use of the same reference numbers as in FIGS. 1 and 2, FIG. 5 shows the effects of the flow of the hot gases resulting from the provisions of FIGS. 2 to 4. In this respect, reference may be had briefly to the disadvantages of the known heat exchanger using the nomenclature of FIG. 1.

Regular optimal hot-gas flow conditions can, in this regard, be taken as a basis merely with respect to the straight leg portions 4, 5 of the matrix (FIG. 1) which project as a block linearly into and transversely of the hot-gas flow H. In this region of the matrix, the individual tubes are uniformly internested with each other assuring a predetermined dependable uniform flow of hot gases. The rows of tubes can therefore be traversed by the stream of hot gases H and provide a suitable crossflow/counterflow heat exchange process.

As a result of the arrangement of the tubes in the arcuate reversal region 6 of the matrix 3 in the prior art construction, hot gas throttling thereat is relatively slight and there is an imbalance of mass-flow density of the hot gases between the reversal region 6 and the straight leg portions 4, 5. The hot gas/compressed-air heat exchange process is relatively unfavorable in the reversal region 6. In order to induce the gas stream to flow at least along the contour of the curved region 6, a relatively long guide wall is necessary.

Furthermore, the portions of hot gas flowing out of the arcuate reversal region 6 of the matrix 3 (FIG. 1) at a relatively high velocity can impair the flow of hot gases through the remainder of the matrix with the predominantly straight legs of the tubes producing mixing turbulence By virtue of the construction according to FIGS. 2 to 4, there can be developed, as shown in FIG. 5, a zone 7 through which there is only a weak flow of hot gases, zone 7 being indicated by cross hatching Zone 7 is formed on one side by the contour of the arcuate region 6 and on the interior of region 6 by a boundary line which is essentially centrally curved in the opposite direction to form a mushroom cap-like shape In contradistinction to the prior art which has been described, therefore, in accordance with FIG. 5, the essential part of the arcuate matrix reversal region 6 can also be traversed by hot gas in accordance with the sequence of arrows $H_1$, $H_2$, $H_3$ so that an effective crossflow/counterflow heat-exchange process is possible, this as the result of the local mutual reduction in cross section of the flow passage for the hot gases (area $F_2$ in FIG. 4), which, in turn, results in the weakly traversed zone 7 and thus in the hot-gas flow $H_1$, $H_2$, $H_3$ which is bulged inward opposite the curvature of the contour of the arcuate region 6. At the same time, the imbalance of mass flow density in the prior art construction between the arcuate reversal region 6 of the matrix 3 and the straight leg portions 4, 5 can be substantially eliminated and an undisturbed homogeneous flow through the entire matrix 3 can be obtained with substantially identical velocities at all portions of the hot gas flow through the matrix 3 at $H_1$, $H_2$, $H_3$, $H_4$, $H_5$, $H_6$.

In accordance with FIG. 5 a boundary 8, formed, for instance, as a direct or indirect component of a housing 10 which guides the hot gases through the matrix, can be constructed to extend a relatively short distance along the outer contour of region 6 of the matrix 3, i.e. over a short distance in the arcuate direction of the reversal region, whereas the housing 10 can extend parallel to the main direction of flow H of the hot gases.

As shown for instance, diagrammatically in FIG. 5, the boundary 8 can be maderelatively short in the arcuate direction an can be attached for displacement on the housing 10 via a supporting bracket 9. Seals (not shown) for preventing flow of the hot gase can be provided between boundary 8 and housing 10, and adapted to compensate for movement of the bracket 9. Furthermore, the bracket 9 can itself produce the necessary sealing between boundary 8 and housing 10.

In distinction from FIG. 5, a longitudinally divided boundary consisting of two shell elements can be provided which can be supported for displacement by holding means on the heat exchanger housing.

In contradistinction to the embodiment of the invention in FIGS. 2 to 4, in which the curved bend regions of the tubes, for instance $6_1$ , $6_2$ to $6_{10}$, are spaced uniformly in radial planes, the curved bend regions can have non-uniform spacing radially.

Figure 6:
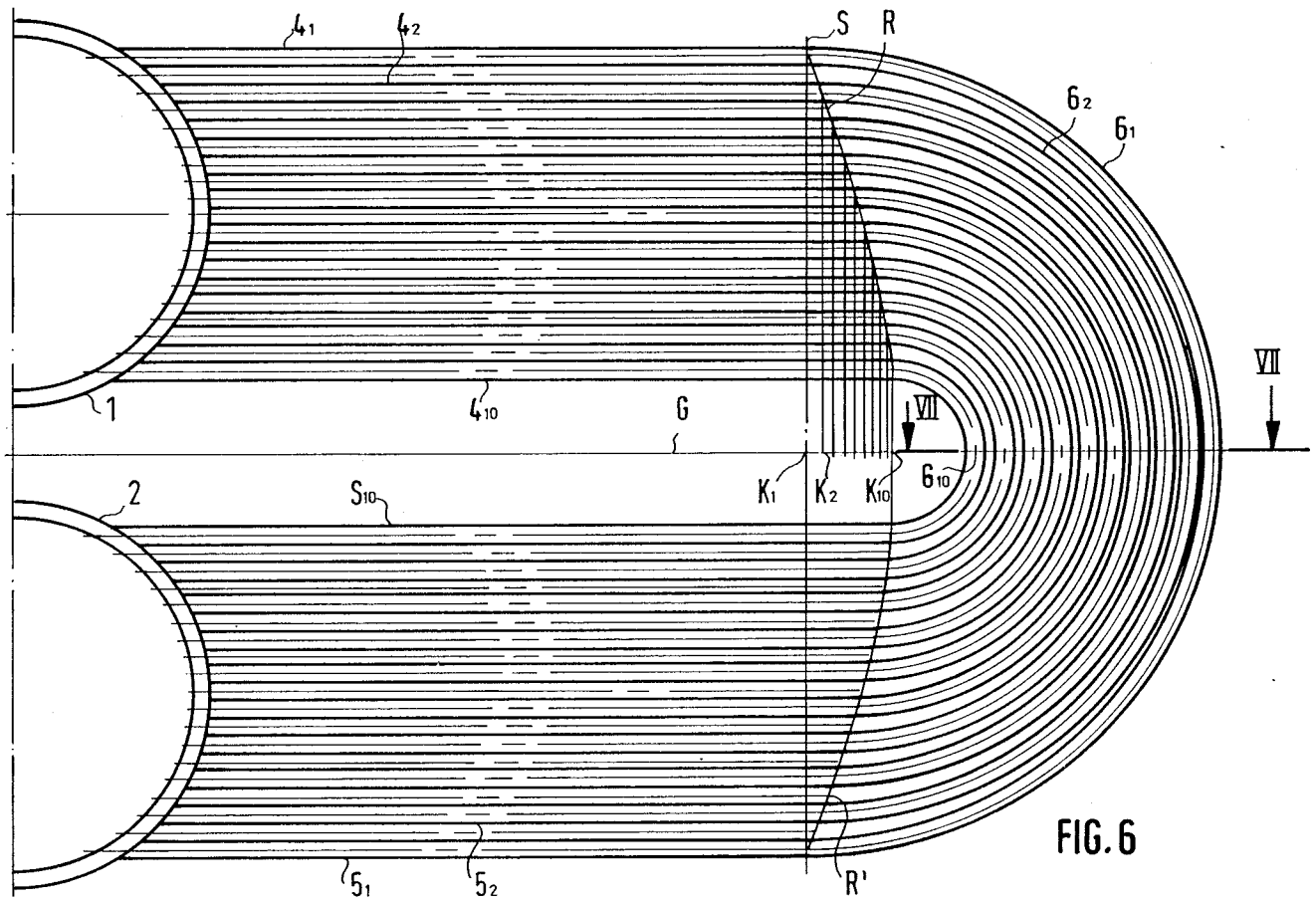
FIG. 6 is a front elevational view of the right-half of a heat exchanger according to a second embodiment of the invention.
Figure 7:
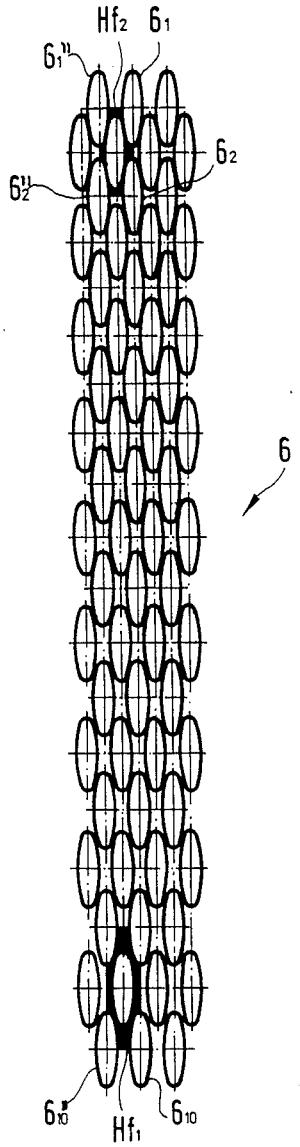
FIG. 7 is a partial section taken along line VII—VII in FIG. 6.

Thus, as shown in FIGS. 6 and 7, the curved bend regions $6_1$, $6_2$, $6_{10}$ which define the arcuate reversal region 6 are spaced progressively smaller distances one from the other, as shown the median section in FIGS. 6 and 7 in the direction from the innermost tube $6_{10}$ of smallest radius of curvature to the outermost tube of largest radius of curvature. In this regard the centers coresponding to the tubes $6_1$, $6_2$ to $6_{10}$ in FIG. 6 are shown at K , $K_2$ to $K_{10}$ on the straight line G. In contradistinction to FIG. 2, the ends of the straight legs extend in correspondence to the decreasing spacing of the centers ($K_1$ to $K_{10}$) along a slightly continuously arcuate path obliquely to the perpendicular S.

In accordance with the illustration of the internested field in FIG. 7 and the passage area $H_{f1}$ for hot gas flow, shown in black at the inner region of the reversal region 6, as well as passage area $H_{f1}$ at the outer part of the reversal region 6, a progressive reduction in the passage area for hot gas flow is obtained continuously from the interior of the reversal region 6 to the exterior thereof.

In the embodiment according to FIGS. 6 and 7, a path of flow $H_1$ to $H_6$ which is comparable to that in FIG. 5 is to be expected in view of development of zone 7 therein as in FIG. 5.

In a manner not further shown, the invention could also be satisfied if the bend regions of the tubes in the median plane of the arcuate reversal region were to lie one above the other in the direction from the innermost tube with the smallest radius of curvature to the outermost tube with the largest radius of curvature, initially in continuously relatively large and then in relatively small uniform distances apart.

In contradistinction to the previous embodiments according to FIGS. 2 to 5 and FIGS. 6 and 7 in which the tubes have circular bend regions in reversal region 6, it is possible to form the reversal region 6 from a combination of circular and elliptical bend portions or only from elliptical bend portions.

Figure 9:
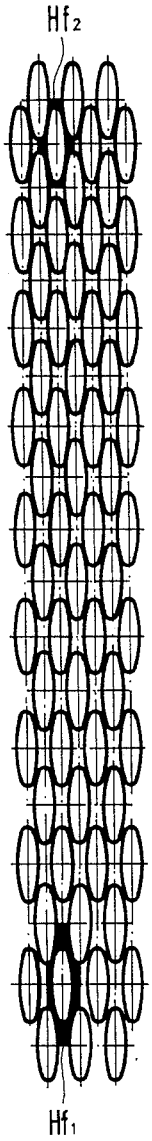
FIG. 9 is a section taken along line IX—IX in FIG. 8.
Figures 8, 8A:
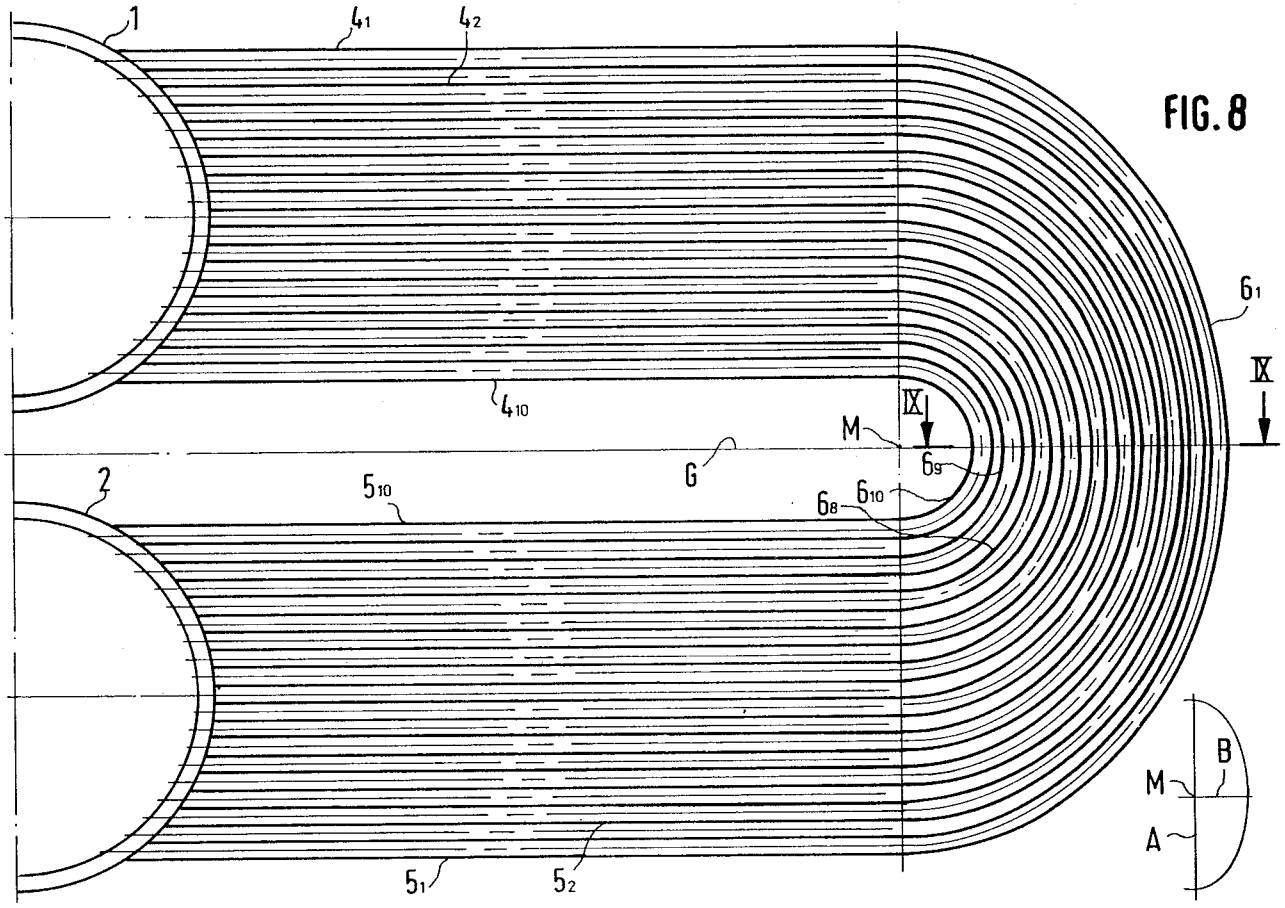
FIG. 8 is a front elevational view of the right-half of a heat exchanger according to a third embodiment of the invention.
FIG. 8A diagrammatically illustrates the contour of the curved region of the matrix of FIG. 8.

In the embodiment shown in FIGS. 8 and 9, the curved tube $6_{10}$ lying furthest inward is circular while the subsequent tubes $6_9$, $6_8$ to $6_{10}$ are elliptical. The same center is used for all of the tubes $6_{10}$ to $6_1$ as shown at M on the median line G. In FIG. 8A therefore the long axis (A) of an elliptically curved reversal region is preestablished by the uniform spacing of the straight leg portions 4, 5 (tubes $4_1$, $4_2$ to $4_{10}$ and $5_1$, $5_2$ to $5_{10}$) and the short axis (B) by the selected spacing in the median plane (section IX—IX). In this respect, in FIGS. 8 and 9 there is provided a spacing between the tubes which continuously decreases from the inside to the outside within the arcuate region of the matrix, and in accordance with FIG. 9, similar to FIG. 7, this leads to a constantly progressing reduction in flow area for hot gases from the outside to the inside as indicated by an inner, relatively large flow area $H_{f1}$ and an outer, relatively small flow area $H_{f2}$.

The construction according to FIGS. 8 and 9 can reduce the matrix volume (tubes $6_1$ to $6_{10}$) forming the reversal region 6 of the matrix 3, for an equivalent matrix structural length and width, as compared to the embodiments of FIGS. 2 to 7 while, at the same time, providing an increased length of the straight leg potions 4, 5.

In FIGS. 4 and 8 a hot-gas flow comparable approximatel to that in FIG. 5 will be obtained, in combination with a weakly traversed zone 7.

In accordance with FIGS. 2, 5, 6 and 8, the median plan of the arcuate reversal region 6 extends midway and parallel betwee the two straight leg regions of the matrix. The straight lines G (FIGS. 2 and 6) which contain the centers $K_1$, $K_2$, $K_6$ or the small axis B (FIG. 8) of the elliptically curved or semi-elliptically curved tubes $6_1$ to $6_{10}$ respectively lie in this plane.

As can furthermore be noted from FIGS. 3, 4, 7 and 9, the curved bend regions of the tubes each has an elongated oval cross section.

The narrower spacing in accordance with the invention of the curved bend portions of the tubes at the zenith of the arcuate region 6 permits, in advantageous manner, also the solution of the mechanical problem of maintaining the predetermined distances between the matrix tubes during the operation of the heat exchanger. In the absence of special measures, the arcuate regions of the tubes can easily be deflected in transverse direction out of their normal position, since such an elastic movement is produced by bending the tube around the axis of its smallest moment of flexural resistance. Transverse oscillations of the tube bend portions as a result of this movement can interfere with the outer flow of the hot gases and its heat exchange with the compressed air and should therefore be avoided. For this purpose, it is necessary to support the tubes against each other in the arcuate region. This support should not interfere with the basic principle of this heat exchanger construction in accordance with which each individual ben region is to be able to expand without constraint in length. On the other hand, support in this region should not block the cross sections for lengthwise flow.

In order to satisfy these requirements, it is proposed, arcuate reversal region be formed with bulges, for instance, locally at the zenith of the arcuate reversal region. The bulges are formed near the ends of the tubes along their larger axes, to such an extent that the tubes bulge laterally outward in controlled fashion as shown at 10′ in FIG. 10. The formation of bulges 10′ can be effected bmeans of special tools so that the shape of the bulged profiled section is precise and reproducible. Tools 11, 12 as shown in FIG. 11 can be utilized for this purpose.

Figure 10:
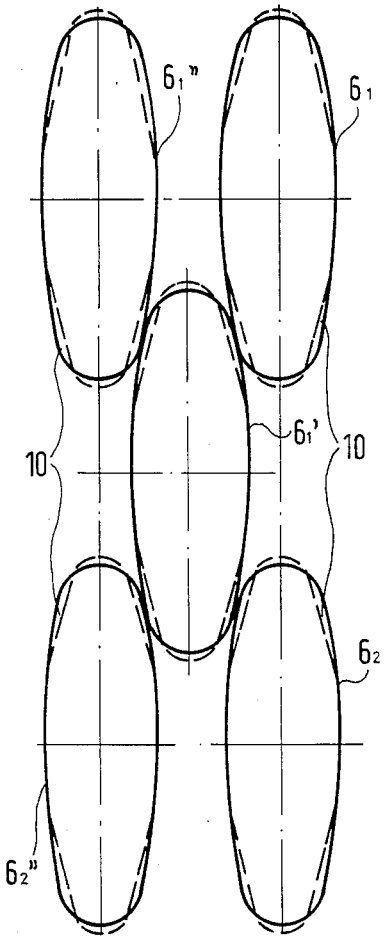
FIG. 10 is a sectional view similar to FIG. 4 showing mutual support of tubes of the matrix by provision of bulges on the outer surfaces of the tubes.
Figure 11:
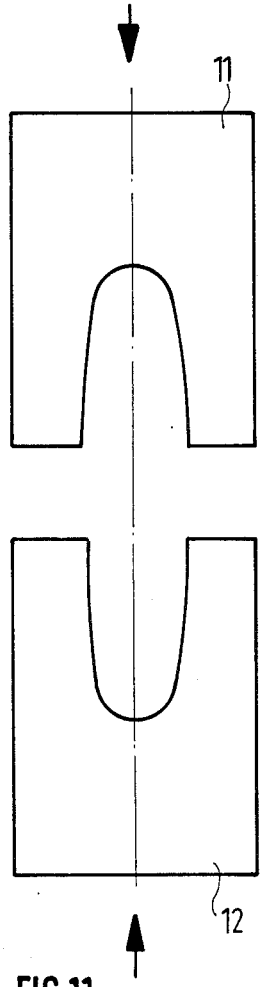
FIG. 11 is a side view of a mold, shown diagrammatically, suitable for production of the bulges on the tubes in FIG. 10.

Upon the assembling of the curved bend portion of the tubes treated in this manner so as to produce the onfiguration of th arcuate reverse region 6 of the invention, an engagement results in this region, as shown in FIG. 10. In this way, the above-mentioned conditions for the mutual support of the tubes are satisfied. If necessary, the contact locations of the profile surfaces can be provided with an anti-wear protective layer.

Although the invention has been described in relation to specific embodiments thereof, it will become apparent to those killed ithe art that numerous modifications and variations can be made within the scope and spirit of the invention as defined in the attached claims.

What is claimed is:

1. A heat exchanger comprising an inlet duct for admission of a first fluid to be heated, an outlet duct for discharge of said first fluid after heating thereof, said ducts being arranged in substantially parallel relation, an assembly of a plurality of heat exchanger tubes connected to said inlet and outlet ducts for receiving said first fluid from the inlet duct to convey said first fluid through said tubes for discharge into said outlet duct, said heat exchanger tubes being of U-shape, each including first and second straight leg portions respectively connected to said inlet and outlet ducts and a curved bend region connecting said straight leg portions for reversing the direction of flow of said first fluid from said first leg portion to said second leg portion, said assembly of heat exchanger tubes projecting laterally of said ducts into the path of travel of a second fluid which flows around said tubes in a passage area, said assembly of heat exchanger tubes being arranged in a matrix of rows and columns, the tubes in said columns being disposed in common planes extending parallel to one another and perpendicular to said ducts, said straight leg portions in said common planes being spaced apart equal distances, the curved bend regions of said tubes in said common planes being arranged from an innermost tube of smallest radius of curvature to an outermost tube of largest radius of curvature, the curved bend regions of adjacent tubes having a spacing in each common plane which is greater between the curved bend regions closer to the innermost tube as compared to the spacing between the curved bend regions of adjacent tubes closer to the outermost tube to provide a throttle region for flow of the second fluid at the curved bend regions of the tubes closer to the outermost tube and thereby obtain substantially undisturbed homogenous flow of said second fluid through the tube matrix.

2. A heat exchanger as claimed in claim 1 wherein in each said common plane, the spacing of the curved bend regions of adjacent tubes progressively diminishes in said plane as measured from the connection of said curved bend portions and said straight leg portions to a median plane therebetween extending perpendicular to said common plane and parallel to said straight leg portions.

3. A heat exchanger as claimed in claim 2 wherein said curved bend regions of the tubes have equal spacing in said common planes along the length of the ducts.

4. A heat exchanger as claimed in claim 2 wherein said curved bend regions of said tubes are semi-circular, said tubes having centers located on a common line, said centers being spaced by distances corresponding to the spacing between the tubes and the progressively increasing radii thereof such that said centers are progressively displaced radially outwards from the innermost to the outermost tubes.

5. A heat exchanger as claimed in claim 2 wherein said curved bend regions of said tubes have a common center of curvature.

6. A heat exchanger as claimed in claim 5 wherein said curved bend regions are elliptical, said matrix defining an elliptical outer contour for said bend regions which in each said common plane has a major axis measured from said common center of curvature to either of said outermost straight leg portions in said common plane and consequently is a function of the spacing between said straight leg portions, and a minor axis measured from said common center to the curved bend region of the outermost tube in a median plane perpendicular to said common plane and parallel to said straight leg portions.

7. A heat exchanger as claimed in claim 1 wherein said curved bend regions of said tubes have respective centers of curvature located in a common plane disposed midway between said first and second straight leg portions of said matrix and parallel thereto.

8. A heat exchanger as claimed in claim 1 wherein said tubes in said curved bend regions are of oval cross section.

9. A heat exchanger as claimed in claim 8 wherein said tubes include local bulge portions at said curved bend regions for contact between the tubes of adjacent rows and columns.

10. A heat exchanger as claimed in claim 9 wherein said bulge portions are provided on said curved bend regions of said tubes in the vicinity of a common plane disposed midway between said first and second straight leg portions of said matrix.

11. A heat exchanger as claimed in claim 1 comprising a housing wall extending parallel to said ducts and bracket means connecting said housing wall to said curved bend regions of the tubes for blocking flow of said second fluid between the housing wall and the curved bend regions of the tubes.

12. A heat exchanger as claimed in claim 11 wherein said bracket means is connected to the curved bend regions of the outermost tubes substantially in a median plane between the straight leg portions.

* * * * *